US007876237B2

(12) United States Patent
Chen

(10) Patent No.: US 7,876,237 B2
(45) Date of Patent: Jan. 25, 2011

(54) ROAD CONE

(75) Inventor: Ming-Chang Chen, Tainan Hsien (TW)

(73) Assignee: Co-Union Industry Co., Ltd., Yung Kang (TW)

( * ) Notice: Subject to any disclaimer, the term of this patent is extended or adjusted under 35 U.S.C. 154(b) by 306 days.

(21) Appl. No.: 12/122,395

(22) Filed: May 16, 2008

(65) Prior Publication Data

US 2009/0195412 A1 Aug. 6, 2009

(30) Foreign Application Priority Data

Feb. 1, 2008 (TW) ..... 97202230 U

(51) Int. Cl.
*B60Q 7/00* (2006.01)

(52) U.S. Cl. ..... 340/908.1; 340/907; 340/908

(58) Field of Classification Search ..... 340/908.1, 340/907, 908
See application file for complete search history.

(56) References Cited

U.S. PATENT DOCUMENTS 2,949,531 A * 8/1960 Lemelson ..... 362/253
4,292,627 A * 9/1981 Knight ..... 340/908
5,294,924 A * 3/1994 Dydzyk ..... 340/908.1
5,453,729 A * 9/1995 Chu ..... 340/332
5,577,824 A * 11/1996 Wright ..... 340/908.1
6,499,858 B2 * 12/2002 Hart ..... 362/183
6,556,147 B1 * 4/2003 Fisher et al. ..... 340/908

* cited by examiner

*Primary Examiner*—Travis R Hunnings
(74) *Attorney, Agent, or Firm*—Glenn H. Lenzen; Polsinelli Shughart PC

(57) ABSTRACT

A road cone includes: a hollow truncated conical body having a top open end defining a top opening; a power supplying unit mounted detachably in the truncated conical body and accessible through the top opening; a cap mounted on the top open end of the truncated conical body and covering the top opening of the truncated conical body; and a light emitting unit mounted in the truncated conical body and connected electrically to the power supplying unit so as to be powered by the power supplying unit to generate light inside the truncated conical body.

8 Claims, 3 Drawing Sheets

ROAD CONE

CROSS-REFERENCE TO RELATED APPLICATION

This application claims priority of Taiwanese Application No. 097202230, filed on Feb. 1, 2008.

BACKGROUND OF THE INVENTION

1. Field of the Invention

The invention relates to a road cone, more particularly to a road cone including a light emitting unit for warning purposes.

2. Description of the Related Art

Road cones are usually used for warning of a construction site or a road under construction as well as for guiding vehicles or participants in sport activities. A conventional road cone is usually coated or attached with a reflective material for better vision of the road cone. The reflective material requires the presence of light so as to be visible in a dark environment. However, visibility of the reflective material is still relatively poor when viewed from a distance while driving at night.

SUMMARY OF THE INVENTION

Therefore, an object of the present invention is to provide a road cone that can overcome the aforesaid drawback associated with the prior art.

Accordingly, a road cone of this invention comprises: a hollow truncated conical body of a light transmissive material having a top open end defining a top opening; a power supplying unit mounted detachably in the truncated conical body and accessible through the top opening; a cap mounted on the top open end of the truncated conical body and covering the top opening of the truncated conical body; and a light emitting unit mounted in the truncated conical body and connected electrically to the power supplying unit so as to be powered by the power supplying unit to generate light inside the truncated conical body.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
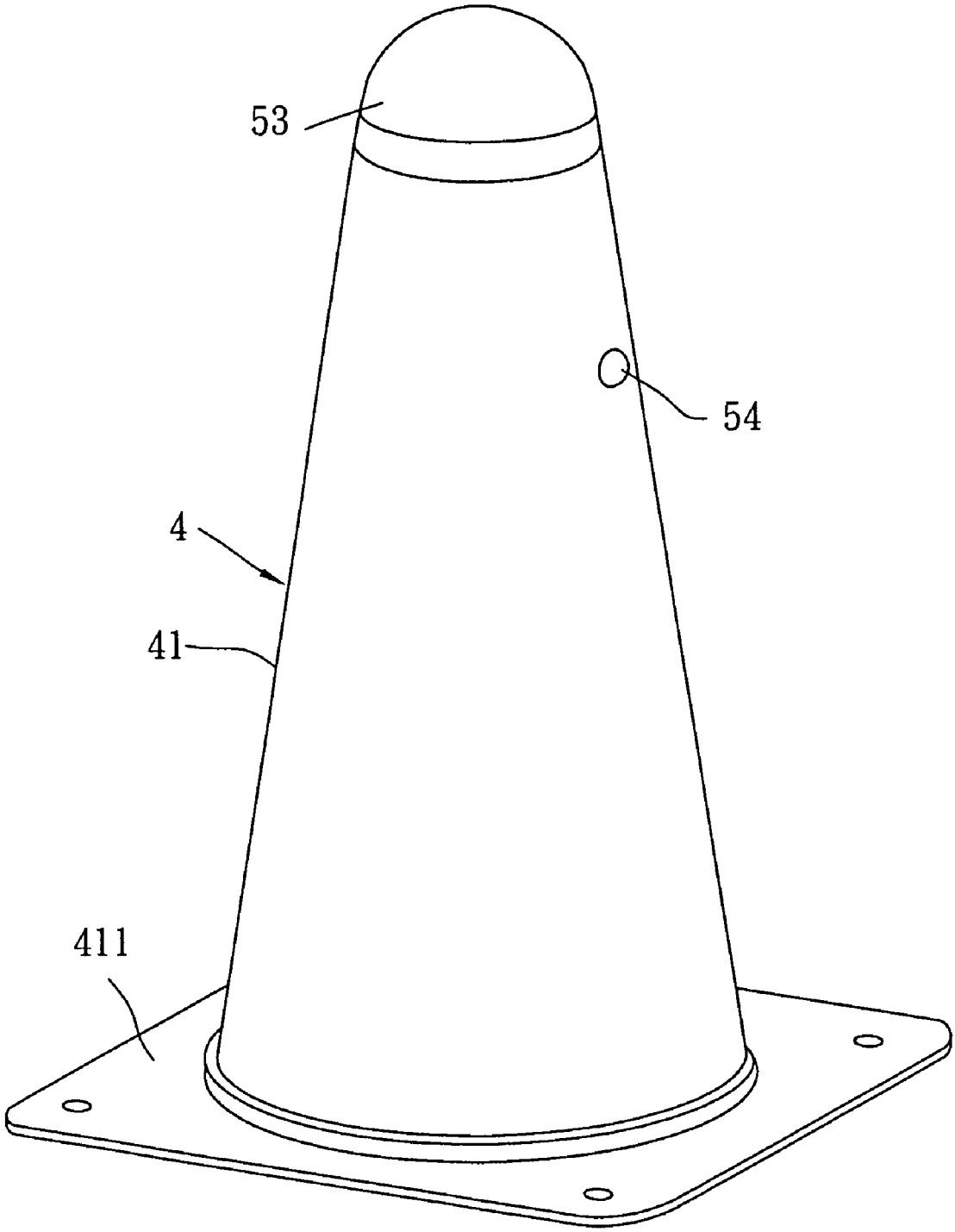
FIG. 1 is an assembled perspective view of the preferred embodiment of a road cone according to the present invention.
Figure 2:
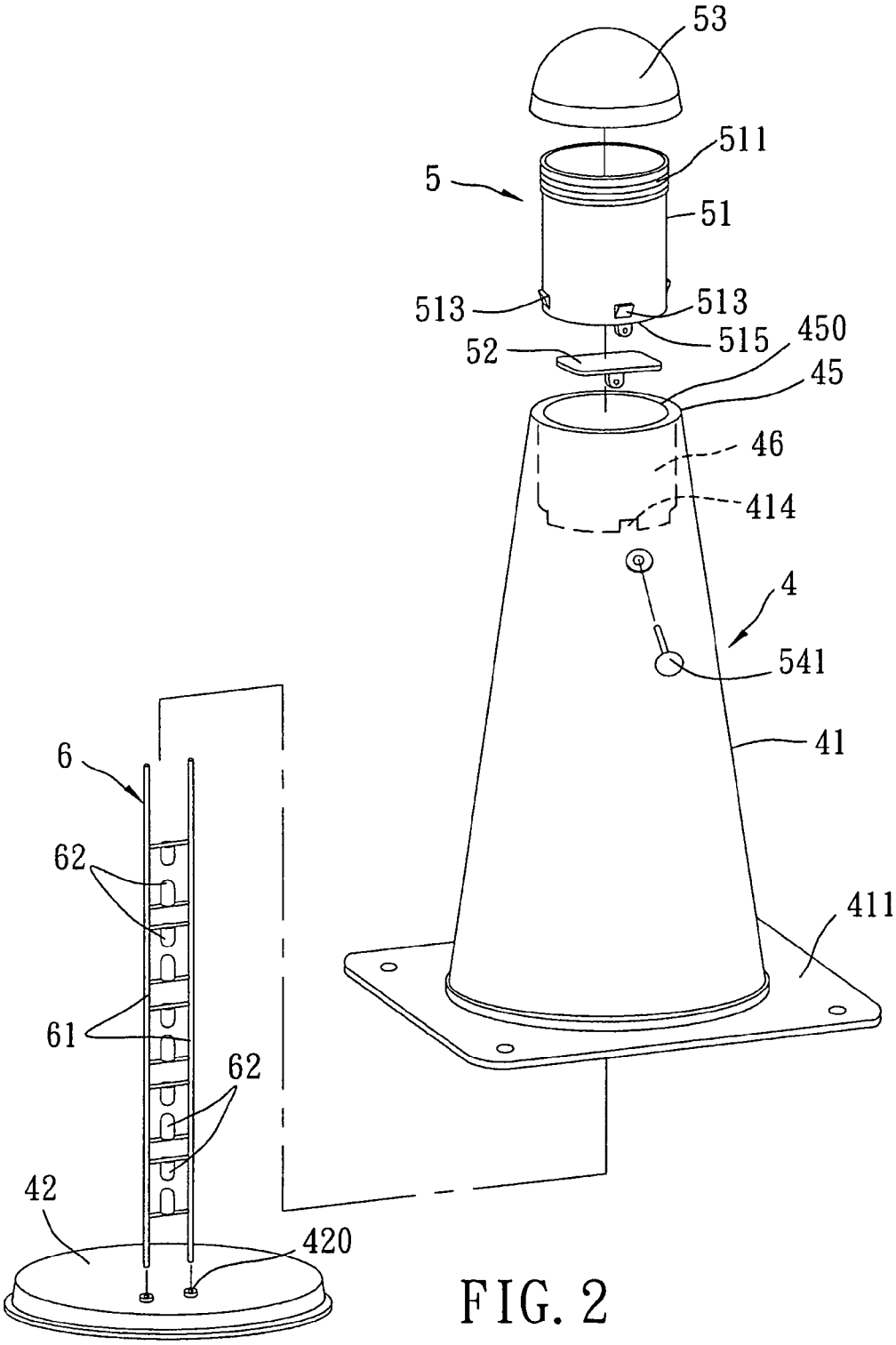
FIG. 2 is an exploded perspective view of the preferred embodiment.
Figure 3:
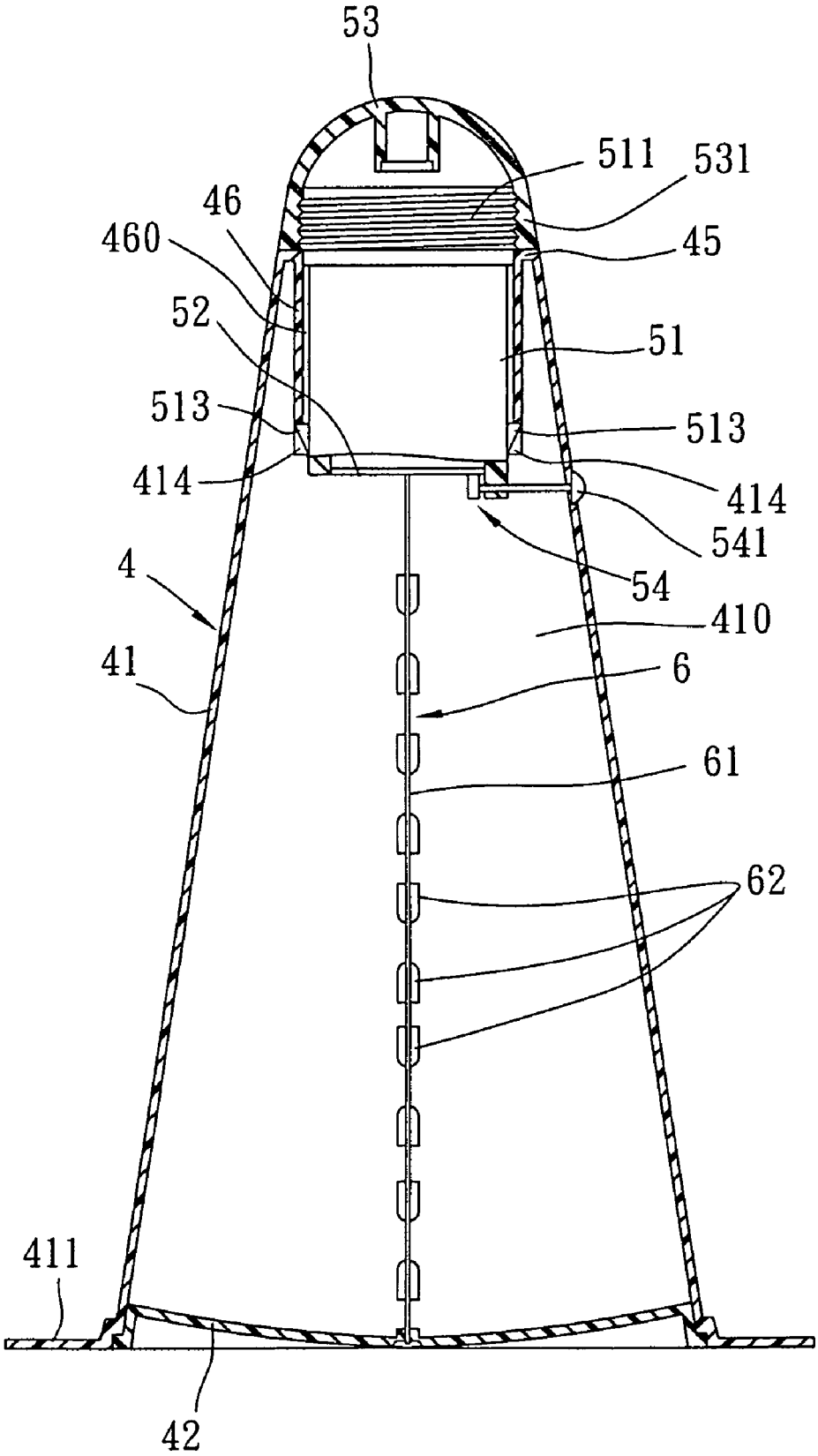
FIG. 3 is a sectional view of the preferred embodiment.

Referring to FIGS. 1 to 3, the preferred embodiment of a road cone according to the present invention is shown to include: a hollow truncated conical body 4 of a light transmissive material having a top open end 45 defining a top opening 450; a power supplying unit 5 mounted detachably in the truncated conical body 4 and accessible through the top opening 450; a cap 53 mounted on the top open end 45 of the truncated conical body 4 and covering the top opening 450 of the truncated conical body 4; and a light emitting unit 6 mounted in the truncated conical body 4 and connected electrically to the power supplying unit 5 so as to be powered by the power supplying unit 5 to generate light inside the truncated conical body 4.

The truncated conical body 4 further has a bottom wall 42. The power supplying unit 5 includes a circuit board 52 and a battery container 51 having a bottom end 515 and adapted to receive at least one battery (not shown) therein. The circuit board 52 is mounted on the bottom end 515 of the battery container 51. The light emitting unit 6 includes a pair of conductive sticks 61 supported on the bottom wall 42 of the truncated conical body 4, extending between the bottom wall 42 of the truncated conical body 4 and the bottom end 515 of the battery container 51, and connected electrically to the circuit board 52. The light emitting unit 6 further includes a plurality of light emitting members 62 disposed along and connected electrically to the conductive sticks 61 in a parallel connection manner. The bottom wall 42 of the truncated conical body 4 is formed with two insert holes 420. The conductive sticks 61 extend fittingly into the insert holes 420, respectively. In this embodiment, each of the light emitting members 62 is a light emitting diode.

The truncated conical body 4 further has an outer surrounding wall 41 that defines the top open end 45 of the truncated conical body 4 and that confines an inner space 410 therein, and an inner supporting wall 46 that is disposed in the inner space 410, that extends downwardly from the top open end 45 of the outer surrounding wall 41, and that defines an accommodating space 460 therein. A bottom flange 411 extends outwardly and laterally from a bottom of the outer surrounding wall 41. The battery container 51 extends into the accommodating space 460 and is supported on the inner supporting wall 46.

The inner supporting wall 46 of the truncated conical body 4 is formed with a plurality of retaining grooves 414. The battery container 51 is formed with a plurality of retaining protrusions 513 engaging the retaining grooves 414, respectively. The battery container 51 has an upper threaded end 511 extending outwardly of the truncated conical body 4. The cap 53 has a lower threaded end 531 engaging threadedly the upper threaded end 511 of the battery container 51.

The road cone 3 further includes a switch 54 connected electrically to the circuit board 52 for turning on and off the light emitting unit 6. The switch 54 includes a pressible button 541 disposed on an exterior of the truncated conical body 4 and extending into the truncated conical body 4.

In use, the battery is installed into the battery container 51, and the pressible button 541 is pressed to actuate the light emitting members 62 so as to generate light inside the road cone.

With the inclusion of the light emitting unit 6 in the road cone of this invention, the aforesaid drawback associated with the prior art can be alleviated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A road cone comprising:

a hollow truncated conical body of a light transmissive material having a top open end defining a top opening;

a power supplying unit mounted detachably in said truncated conical body and accessible through said top opening;

a cap mounted on said top open end of said truncated conical body and covering said top opening of said truncated conical body; and a light emitting unit mounted in said truncated conical body and connected electrically to said power supplying unit so as to be powered by said power supplying unit to generate light inside said truncated conical body, wherein said truncated conical body further has a bottom wall, said power supplying unit including a circuit board and a battery container having a bottom end and adapted to receive at least one battery therein, said light emitting unit including a pair of conductive sticks supported on said bottom wall of said truncated conical body, extending between said bottom wall of said truncated conical body and said bottom end of said battery container, and connected electrically to said circuit board, said light emitting unit further including a plurality of light emitting members disposed along and connected electrically to said conductive sticks in a parallel connection manner.

2. The road cone as claimed in claim 1, wherein said bottom wall of said truncated conical body is formed with two insert holes, said conductive sticks extending fittingly into said insert holes, respectively.

3. The road cone as claimed in claim 1, wherein each of said light emitting members is a light emitting diode.

4. The road cone as claimed in claim 1, wherein said truncated conical body further has an outer surrounding wall that defines said top open end of said truncated conical body and that confines an inner space therein, and an inner supporting wall that is disposed in said inner space, that extends downwardly from said top open end of said outer surrounding wall, and that defines an accommodating space therein, said power supplying unit including a battery container that extends into said accommodating space, that is supported on said inner supporting wall, and that is adapted to receive at least one battery therein.

5. The road cone as claimed in claim 4, wherein said inner supporting wall of said truncated conical body is formed with a plurality of retaining grooves, said battery container being formed with a plurality of retaining protrusions engaging said retaining grooves, respectively.

6. The road cone as claimed in claim 1, wherein said power supplying unit includes a battery container that has an upper threaded end extending outwardly of said truncated conical body, said cap having a lower threaded end engaging threadedly said upper threaded end of said battery container.

7. The road cone as claimed in claim 1, further comprising a switch connected electrically to said circuit board for turning on and off said light emitting unit.

8. The road cone as claimed in claim 7, wherein said switch includes a pressible button disposed on an exterior of said truncated conical body and extending into said truncated conical body.

* * * * *